United States Patent [19]

Nanasi et al.

[11] Patent Number: 4,542,630

[45] Date of Patent: Sep. 24, 1985

[54] DECORATIVE ORNAMENT FOR A BAND OR CHAIN

[75] Inventors: John Nanasi, Englewood, N.J.; Ernest Reinitz, Yorktown Heights, N.Y.

[73] Assignee: Nei Gold Products Inc., New York, N.Y.

[21] Appl. No.: 562,856

[22] Filed: Dec. 19, 1983

[51] Int. Cl.[4] ..... A44C 5/00

[52] U.S. Cl. ..... 63/3; 63/2; 24/170; 24/495

[58] Field of Search ..... 63/1, 2, 3, 20, 23; 24/495, 496

[56] References Cited

U.S. PATENT DOCUMENTS

| | | | |
|---|---|---|---|
| 293,418 | 2/1884 | Church | 63/3 |
| 1,756,041 | 4/1930 | Vance | 63/3 |
| 2,225,890 | 12/1940 | Schwartzkopf | 63/2 |
| 2,271,133 | 1/1942 | Thoresen | 24/170 |
| 2,496,891 | 2/1950 | Preszler | 24/170 |
| 2,586,758 | 2/1952 | Zerr | 24/2 |
| 3,323,324 | 6/1967 | Bohlinger et al. | 63/20 |
| 3,348,388 | 10/1967 | Elliott | 63/1 R |

*Primary Examiner*—F. Barry Shay

*Attorney, Agent, or Firm*—Jacobs & Jacobs

[57] ABSTRACT

A flexible, elongated band has a removable ornament thereon that can be intentionally removed from the band but cannot be accidentally removed.

6 Claims, 9 Drawing Figures

FIG. 1
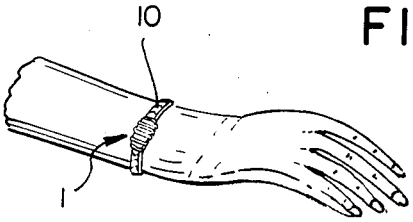
FIG. 2
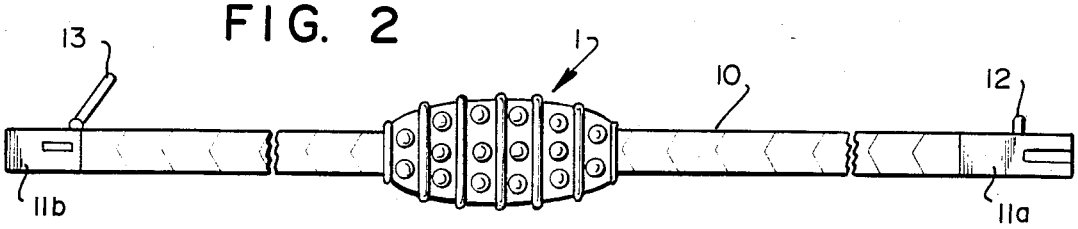
FIG. 9
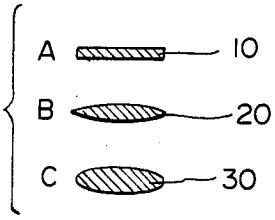
FIG. 3
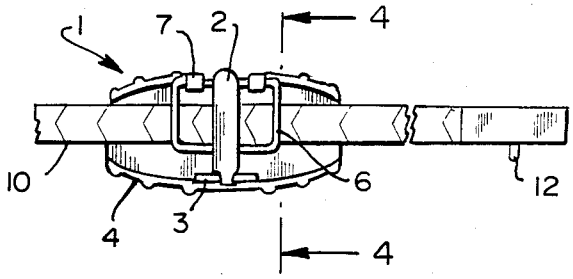
FIG. 4
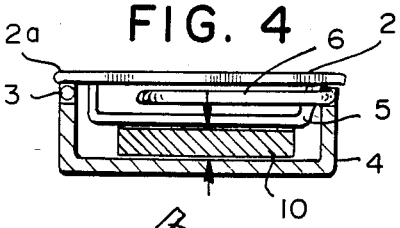
FIG. 5
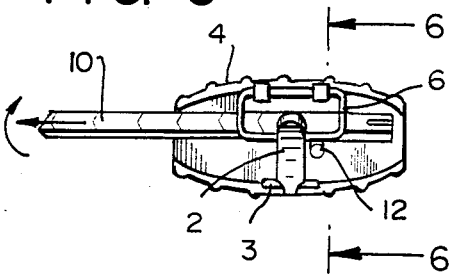
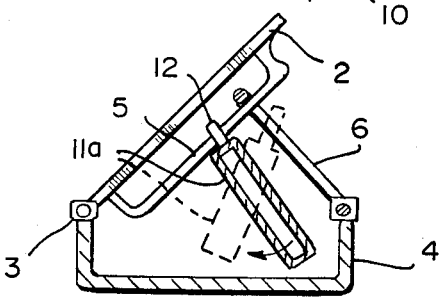
FIG. 6
FIG. 7
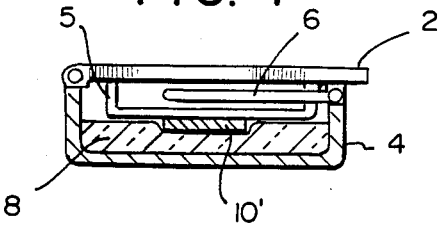
FIG. 8
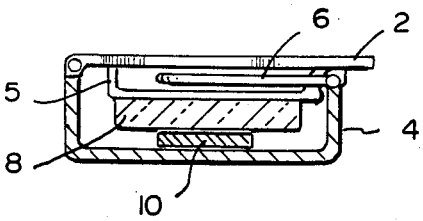

DECORATIVE ORNAMENT FOR A BAND OR CHAIN

The present invention relates to jewelry, and more particularly to bracelets or the like having a flexible band or chain to which is detachably secured a decorative item. More particularly, the present invention relates to such a decorative item having means whereby the decorative item can be intentionally removed from the flexible band or chain, but its accidental removal is prevented.

The present invention is based upon the use of a decorative or ornamental device that is secured to a flexible band or chain, usually used as a bracelet. The decorative or ornamental device is provided with means permitting the device to be placed on the flexible band or chain and removed when desired. It is contemplated that the consumer will initially buy a flexible band or chain to which is detachably secured one decorative or ornamental device, for example, with simulated or real rubies, and will purchase at the same time or subsequently thereafter additional decorative or ornamental devices of other designs and/or with other colored stones. In order to prevent the loss of the decorative or ornamental device during replacement of one device with another, and to prevent the decorative or ornamental device from becoming accidentally detached from the flexible band or chain during use, the decorative or ornamental device and the flexible band or chain have cooperating means to prevent such accidental removal. These cooperating means also facilitate the exchange of one decorative or ornamental device for another.

The present invention is illustrated in terms of its preferred embodiments in the accompanying drawing, in which:

FIG. 1 is a view in perspective showing the present invention in the form of a bracelet worn on the arm of a user;

FIG. 2 is a top plan view of the bracelet illustrated in FIG. 1, with the ends of the bracelet detached from one another;

FIG. 3 is a detail view of the underside of the bracelet shown in FIG. 2;

FIG. 4 is a view in section taken along lines 4—4 in FIG. 3;

FIG. 5 is a detail view of the underside of the bracelet of the invention showing the first step in removing the flexible band or chain from the ornamental device;

FIG. 6 is a view in section taken along lines 6—6 in FIG. 5;

FIG. 7 is a view in section similar to FIG. 4 of an alternative embodiment according to the invention;

FIG. 8 is a view in section similar to FIG. 4 showing yet another embodiment of the invention; and FIG. 9 is a diagrammatic view of alternative cross-sections for the flexible band or chain.

Referring to the drawing, FIG. 1 shows an ornamental device carried by a flexible band 10 worn on the arm of a user as a bracelet.

FIG. 2 shows the band 10 as having cooperating clasp parts 11*a*, 11*b* affixed to the opposite ends thereof. Clasp part 11*a* has a lug 12 projecting therefrom and clasp part 11*b* has a loop 13 affixed thereto. When the parts 11*a* and 11*b* are joined together to form the clasp, loop 13 is snapped over the lug 12 to insure that the clasp parts 11*a*, 11*b* do not become accidentally detached.

It is contemplated that the owner of the bracelet will, from time-to-time, replace the ornamental device with another device of different ornamentation. FIGS. 3 and 4 show the ornamental device 1 secured to the flexible band or chain 10. Thus, a lever 2 is pivotally mounted on the ornamental device 1 by means of the pin 3 that is secured to the U-shaped housing 4 having an open top, a bottom wall portion and opposed side wall portions as viewed in FIG. 4, the pin 3 passing through a loop portion 2*a* (FIG. 4) of the lever 2. Lever 2 has a large loop member 5 secured to the underside thereof which bears against the flexible band or chain 10 and holds the band or chain 10 in place by means of friction. See FIG. 4, where the arrows show the forces acting on band 10 to hold it in place. Completing the assembly is a bail 6, whose function will be described hereinafter. Bail 6 is secured to the housing 4 by means of rings 7 (FIG. 3).

FIG. 5 shows the position of lever 2 when it is desired to remove the ornamental device 1 from the band or chain 10. Thus, to accomplish this removal, one simply rotates lever 2 about the pin 3 in the direction out of the plane of the drawing as viewed in FIGS. 3 and 5. This opening movement of the lever 2 causes the bail 6 to be raised upwardly and away from the ornamental device 1, as shown in FIG. 6. Accidental detachment of the band 10 from the ornamental device 1 is prevented because when the band 10 moves in the direction shown by the arrow in FIG. 5, its movement will be terminated when the lug 12 abuts against the large loop 5, as shown in FIGS. 5 and 6. If the band 10 moves in the opposite direction, then the member 13 will abut against the opposite side of the large loop 5. In either case, the band 10 cannot be accidentally detached from the ornamental device 1.

When it is desired to exchange one ornamental device for another, lever 2 will be moved to the position shown in FIG. 5 and the band 10 moved in the direction of the arrow shown in FIG. 5 until lug 12 abuts against large loop 5. The clasp part 11*a* will then be rotated in the direction shown by the arrows in FIG. 6 to permit the lug 12 to enter into the interior open space of bail 6. The position of the clasp part 11*a* will then be as shown in the dotted line. Further movement of the band 10 in the direction of the arrow shown in FIG. 5 is unobstructed by loop part 5. When lug 12 contacts the far side of bale 6, the clasp 11*a* is rotated in the opposite direction so that it can be freed from the bail 6. Further movement of the band 10 in the direction shown by the arrow in FIG. 5 will entirely separate the band 10 from the ornamental device 1. Assembly of a new ornamental device to the band 10 is accomplished by reversing the instructions given above for detaching the band 10 from the ornamental device 1.

FIG. 7 illustrates an alternative embodiment of the invention in which the inner surface of the ornamental device 1 carries a flexible pad 8 secured thereto by means of a suitable adhesive (not shown). In this way, a significantly thinner band 10' can readily be held securely in place in the ornamental device 1.

FIG. 8 is similar to FIG. 7 and in this case the flexible pad 8 is secured by suitable adhesive (not shown) to the underside of the large loop 4.

In addition to the rectangular cross-section for the flexible bands 10 and 10', any suitable cross-section can be used, such as the cross-sections of bands 20 and 30 shown in FIG. 9.

While the band 10 may usually be considered as a bracelet as shown in FIG. 1, depending upon the flexibility and suppleness of the band, it may also be used as a necklace.

I claim:

1. A flexible, elongated band means having a removable ornament means thereon, wherein said ornament means comprises a housing means having an open top, a bottom wall portion and opposed side wall portions, lever means pivotally mounted at one end thereof on one side wall portion, and bail means mounted on said opposed side wall portion for swinging between a first position wherein it is adjacent said bottom wall portion and a second position wherein it is remote therefrom, said lever means being pivotally movable between first and second positions wherein the open top of said housing means is closed and open, respectively, said lever means being operatively connected to said bail means to swing said bail means from its first position to its second position as said lever means is pivoted from its first position to its second position; said lever means being operable to engage and hold said band means in said ornament means when said lever means is in said first position and to be disengaged therefrom when said lever means is in said second position; and said band means has means at either end thereof cooperating with said lever means and said bail means to permit intentional separation and prevent unintentional separation of said ornament means from said band means when said lever means is in said second position.

2. Apparatus according to claim 1, wherein flexible pad means is carried by said lever means operable to engage said band means when said lever means is in its first position.

3. Apparatus according to claim 1, wherein flexible pad means is carried by said bottom wall portion of said housing.

4. Apparatus according to claim 1, wherein said cooperating means on said band means are interconnecting parts that together form a clasp for said band.

5. Apparatus according to claim 4, wherein said cooperating means are a lug projecting from said band means at one end thereof and a loop that is snappable over said lug at the other end thereof.

6. Apparatus according to claim 5, wherein when said lever means is in its second position said lug or said loop will abut against said lever means when said band means moves through said ornament means, and further movement of said band means is prevented unless said band means is selectively rotated about its longitudinal axis to clear said lever means.

* * * * *